US005178517A

United States Patent [19]

Reinhorn et al.

[11] Patent Number: 5,178,517

[45] Date of Patent: Jan. 12, 1993

[54] TURBINE BUCKET ROTOR CONSTRUCTION

[76] Inventors: Ed Reinhorn; Matt Reinhorn; Eric J. Reinhorn, all of 10744 Prospect Ave., Ste. A, Santee, Calif. 92071

[21] Appl. No.: 573,474

[22] Filed: Aug. 27, 1990

[51] Int. Cl.[5] ..... B63H 1/00

[52] U.S. Cl. ..... 416/2; 416/223 R; 416/241 A; 415/200; 415/9

[58] Field of Search ..... 416/241 A, 223 R, 2; 415/200, 9

[56] References Cited

U.S. PATENT DOCUMENTS

| | | | |
|---|---|---|---|
| 2,220,669 | 11/1940 | Allen | 416/241 A |
| 3,003,745 | 10/1961 | Ferguson | 416/2 |
| 3,051,440 | 8/1962 | Chandler | 416/2 |
| 3,094,075 | 6/1963 | Logue | 416/241 A |
| 3,097,824 | 7/1963 | Bunger | 416/2 |
| 3,155,045 | 11/1964 | Lown | 416/241 A |
| 3,551,067 | 12/1970 | Wissman | 416/241 A |
| 4,507,047 | 3/1985 | Coons | 415/9 |
| 4,509,896 | 4/1985 | Linsker | 415/9 |
| 4,842,483 | 6/1989 | Geary | 416/2 |

FOREIGN PATENT DOCUMENTS

| | | | |
|---|---|---|---|
| 715923 | 9/1954 | United Kingdom | 415/241 A |

*Primary Examiner*—Edward K. Look
*Assistant Examiner*—Therese M. Newholm
*Attorney, Agent, or Firm*—Ralph S. Branscomb

[57] ABSTRACT

A rotor for an air motor is constructed with a central, milled, aluminum disc having a peripheral flange to which is integrally molded an outer ring of epoxy compound or a composite material, the outer ring defining the series of buckets arranged in an annular ring which are driven by an air nozzle to rotate the rotor. The rotor construction utilizes a combination of old and new materials in a configuration designed to avoid rotor breakup under runaway speed conditions and minimize the damage should such breakup occur.

9 Claims, 1 Drawing Sheet

TURBINE BUCKET ROTOR CONSTRUCTION

BACKGROUND OF THE INVENTION

The rotor of the instant invention is used in air motors ranging in size from a fraction of a horsepower to several horsepower and even to many horsepower. The bucket-type rotor distinguishes the pneumatic motor in which it operates from the vane-type air motor. Rotors for the instant type of motor define an annular row of spaced air scoops which rotate at high speed past an air injector nozzle which drives the motor.

Motors of this type are characterized by being high-speed and low-torque, and would ordinarily require some speed reduction from the rotor speed even for relatively high-speed applications such as for ventilation fans. In order to produce even that amount of torque, the rotor would spin at velocities on the order of 10,000 to 25,000 RPM, with a speed reduction from as little as 2:1 to as much as 12:1.

There are several problems with air motors which have prevented their introduction for general use to replace electric motors, and particularly electric motors which operate in explosion-prone areas in which explosion-proof or spark-proof electric motors are required. Air motors would seem a natural for such applications, but due to the perception on the part of industry that they are loud, require frequent maintenance, and are subject to dangerous rotor fragmentation at high speeds, they have not been generally accepted.

This patent application is co-pending with an application on an air motor which is designed specifically to overcome or minimize the problems associated with air motors, resulting in the production of an air motor which is an alternative to electric motors.

The instant invention pertains to the rotor of the motor of the co-pending application, and is particularly addressed to eliminating the danger inherent in the use of such motors resulting from rotor fragmentation that occurs when using air motors with other types of rotors, when there is a runaway rotor condition in which the rotor is operating at speeds much higher than that for which it is designed.

Other rotors have been developed to eliminate this problem, two of which are disclosed in U.S. Pat. Nos. 4,509,896, and 4,507,047. Those inventions pertain to rotors having an expandable outer ring which expands under the action of centrifugal force to bind against the walls of the chamber in which it rotates when it is overdriven causing it to automatically reduce speed, or at least fail to accelerate, beyond a certain speed.

Although this is certainly a legitimate approach to the solution to the rotor fragmentation problem, it is structurally somewhat complicated and results in considerable wear on the rotor mechanism if it is overdriven too often.

There is a need for a rotor which avoids or resolves the over -driving problem, in a simple and inexpensive and fool-proof manner.

SUMMARY OF THE INVENTION

The rotor of the instant invention does not prevent over-speed driving of the rotor per se. Instead, it is constructed so that first, by reducing the weight of the periphery which defines the rotor buckets which are rotating at the highest speed, the force tending to fragment this portion of the rotor is reduced. Weight is reduced while strength is not seriously impaired by the use of high-strength high-moldability epoxy compounds, which define the buckets and an outer epoxy ring which is molded to the periphery of a central aluminum disc.

This construction, in addition to reducing the explosive centrifugal forces experienced by the outer portion of the rotor also renders the fragmentation of the rotor much less destructive should it ever occur. The high-speed outer ring of the rotor and its molded buckets will not break apart in large, sharp, metal pieces as does an all-metal rotor, but instead breaks apart in chunks which are instantly ground to granular size, or even to a powder, eliminating the danger of tearing apart the motor casing, destroying the motor and posing potentially serious danger to workers in the area.

The epoxy compound ring is joined to the central aluminum disc in a simple yet elegant fashion which renders the outer ring extremely securely bonded to the disc, and provides an inner epoxy disc as well which is easily shaved or otherwise reduced to achieve rotor balance subsequent to the molding the epoxy portion of the rotor around the aluminum disc.

DETAILED DESCRIPTION OF THE PREFERRED EMBODIMENT

Figure 1:
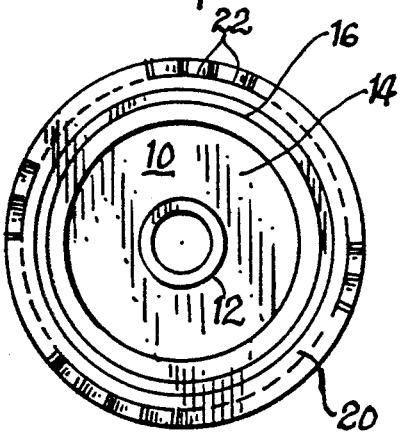
FIG. 1 is a side elevation view of the rotor.
Figure 2:
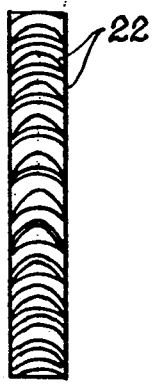
FIG. 2 is an edge elevation view of the rotor.
Figure 3:
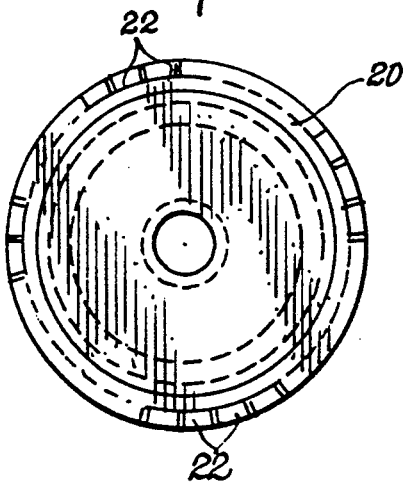
FIG. 3 is a side elevation view of the rotor from the other side than FIG. 1.
Figure 4:
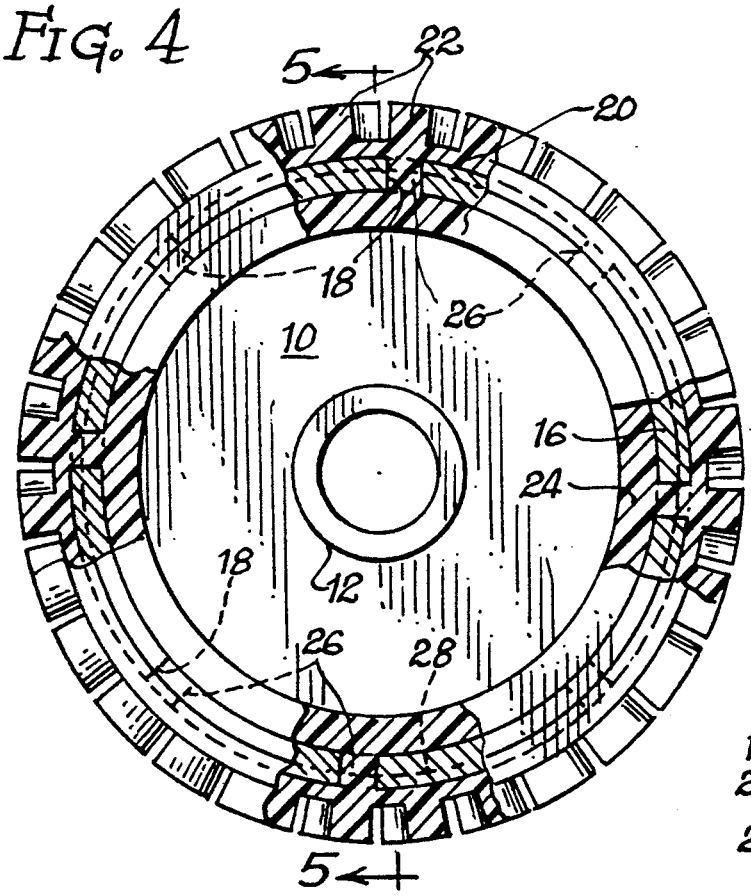
FIG. 4 is an enlarged front elevation view of the rotor with portions cut away to reveal the flow-through epoxy connections between the inner and outer ring.
Figure 5:
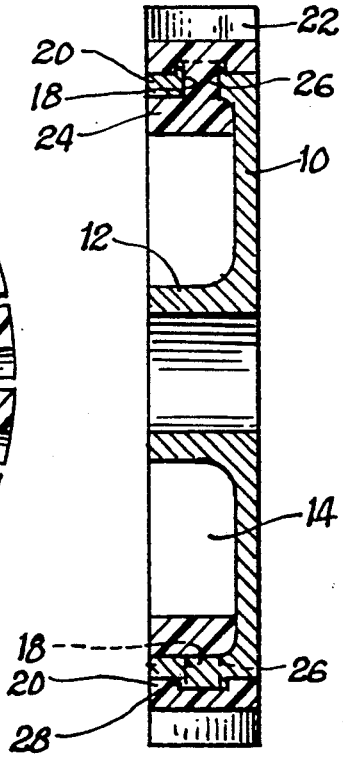
FIG. 5 is section taken along line 5—5 of FIG. 4.
Figure 6:
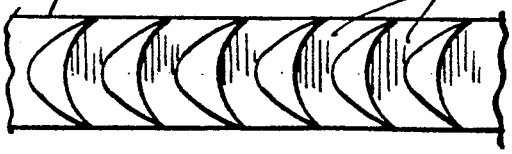
FIG. 6 is an enlarged detail plan view of a segment of the rotor-defining outer ring.

Rotors currently in use in motors of the type described herein are generally solid metal, generally having been milled from a single piece of metallic stock. The instant invention carries over that rotor technology in part by utilizing a central metallic disc 10, which in the models currently being produced is a milled aluminum disc. The disc has a central hub portion 12 which engages on a shaft which is journaled in the motor casing, all of which is shown in considerable detail in the co-pending patent application for the motor itself.

The hub 12 is connected by means of a flat web 14 to a peripheral flange 16. This flange has eight apertures 18 which are radially oriented in the flange, and are on the order of 3/16 of an inch wide. The flange with its apertures serve as the basis for anchoring the non-metallic portions of the rotor.

The non-metallic portions of the rotor are claimed as being "plastic", which is used herein to mean that they could be made from a variety of non-metallic, synthetic and relatively new materials. Specifically, the rotor currently used in the motor is made from a highly moldable epoxy compound.

Other suitable materials falling within the composite classification are for all intents and purposes unlimited. Composites generally comprise some type of resin or epoxy and a fibrous filler material, although the pure epoxy used in the present invention could also be classified as a "composite". Composites are virtually infinite in variety. The modifications of resin type, and the type, size and texture of the filler material that could be used, may be considered, for all human purposes, as unlimited. There are probably hundreds, thousands or tens of thousands of combinations that could be used in the present invention to produce results from adequate to outstanding.

In any event, the "plastic" or epoxy portion of the instant invention defines an outer ring 20, with the outer ring defining the annular row of spaced buckets 22. The outer ring connects to an inner ring 24 by means of eight spikes 26 which pass through the apertures 18, so that a unitary structure is provided incorporating the inner and outer rings and the annular bucket row. The spikes serve to secure the outer ring against any kind of axial, or angular or radial migration. They are assisted in securing the ring against axial migration by the raised shoulder 28 that is produced in the flange of the aluminum disc. The eight spikes, on the order of 3/16 of an inch have served well in the models currently in use to provide adequate strength and interconnection between the two rings.

The inner ring 24 has a dual purpose. In addition to providing a secure anchor for the inner ends of the epoxy spikes 26, the inner ring provides a convenient annular surface which can be milled, shaved, ground or otherwise reduced to balance the finished rotor.

The rotor is reduced from a flexible rubber mold which is engaged on the aluminum disc. The aluminum disc at present is being milled, but in the future could be molded. In any event, the disc is inserted into the flexible rubber mold, and the structure is rotated on a lathe while the relatively fast setting epoxy is injected radially inside the flange 16 as it rotates. The epoxy passes through apertures 18, filling the flexible molds, and finally fills the apertures 18 themselves, after which the inner ring 24 is formed. In several minutes the epoxy is hard enough that rotation can be stopped and the rubber mold removed. It then will take at least 24 hours for the epoxy to adequately cure before the rotor can be put into use.

A modification of the rotor which is made obvious by this disclosure would be a solid epoxy or solid composite rotor in which not only the outer rings and buckets were defined in the synthetic material. This type of product might be in the offing, although at present the use of the inner aluminum disc has its advantages. Either type of construction would accomplish the two goal intended herein which are the reduction of the separating forces experienced at the periphery of the motor at high speed, and the use of a composition in at least the peripheral portion of the rotor which will break apart as smaller (and light-weight) granular chunks rather than large, jagged metallic chunks in the event a runaway condition of high enough magnitude is experienced.

It is hereby claimed:

1. A turbine bucket rotor comprising:

(a) a body comprising a disk having a peripheral annular flange;

(b) an outer ring affixed to said flange and defining a continuous annular row of angularly spaced turbine buckets on the outside thereof; and (c) said outer ring being comprised of a frangible, high-strength material which substantially shatters into harmless fragments int he event said rotor spins beyond the angular velocity at which said material can maintain its structural integrity.

2. The turbine rotor of claim 1 wherein said material comprises a high-moldability plastic compound.

3. The turbine rotor of claim 2 wherein said plastic material is epoxy.

4. The turbine rotor of claim 2 wherein said plastic material comprises a composite.

5. The turbine rotor of claim 1 wherein said flange has an outwardly projecting annular raised shoulder to secure said outer ring against axial displacement.

6. The turbine rotor of claim 1 wherein said flange is provided with spaced substantially radial apertures and said outer ring is unitary with spikes occupying said apertures to secure said outer ring against angular migration.

7. The turbine rotor of claim 6 further comprising an inner ring integral with said spikes and said outer ring, all being comprised of the same material.

8. The turbine rotor of claim 1 wherein the material of said disk is aluminum.

9. A rotor comprising:

(a) a body comprising a disk having a peripheral annular flange;

(b) an outer ring integral with said body and molded to said flange and defining a continuous annular row of angularly spaced buckets on the outside thereof;

(c) said ring comprised of a high-strength plastic material;

(d) said flange being provided with spaced substantially radial apertures and said outer ring being unitary with plastic spikes occupying said apertures to secure said outer ring against angular migration; and (e) an inner plastic ring defined on the radially inner side of said flange and being unitary with said spikes and outer ring, said inner ring being reduced at strategic positions to balance said rotor.

* * * * *